United States Patent [19]

Main

[11] 4,218,940

[45] Aug. 26, 1980

[54] SOCKET RELEASE APPARATUS

[75] Inventor: Doug Main, Denver, Colo.

[73] Assignee: Harvey M. Main, a part interest, Denver, Colo.

[21] Appl. No.: 966,810

[22] Filed: Dec. 6, 1978

[51] Int. Cl.[2] ..... B25B 13/46

[52] U.S. Cl. ..... 81/63; 81/177 G

[58] Field of Search ..... 81/60, 61, 62, 63, 63.1, 81/63.2, 57.29, 177 G; 279/1 B, 75, 66, 22, 30; 403/322, 328, DIG. 8

[56] References Cited

U.S. PATENT DOCUMENTS

| | | | |
|---|---|---|---|
| 2,009,371 | 7/1935 | Junge | 403/328 |
| 2,061,448 | 11/1936 | Bath et al. | 403/328 |
| 3,208,318 | 9/1965 | Roberts | 81/177 G |
| 4,086,829 | 5/1978 | Hudgins | 81/58.1 |
| 4,128,025 | 12/1978 | Main et al. | 81/58.1 |

*Primary Examiner*—James L. Jones, Jr.
*Attorney, Agent, or Firm*—James H. Chafin

[57] ABSTRACT

A remote socket release apparatus for wrenches wherein the release actuation operator is located on the outer end of the wrench handle.

8 Claims, 6 Drawing Figures

SOCKET RELEASE APPARATUS

BACKGROUND OF THE INVENTION

1. Field of the Invention

The present invention relates to a remote socket release apparatus for wrenches and more particularly, but not by way of limitation, to a socket release apparatus adapted for use with ratchet wrenches whereby the operator means for said socket release is located at the outer end of the handle away from the wrench head.

2. History of the Prior Art

In recent years, some ratchet-type wrenches have been provided with a push-button socket release mechanism whereby the user of the wrench may depress a push-button located on the back of the wrench head opposite the drive stud which serves to release a ball detent or other device located on the drive stud in turn release the socket being held thereby.

This feature has the double benefit of not only providing a ball detent for firmly holding the socket in place but also provides a handy means for releasing the socket for changing size.

However, the push-button release device that is presently available has two primary disadvantages, the first being that dropping or mishandling the wrench often results in damage to the push-button thereby rendering the wrench inoperable. Secondly, the push-button is an added protrusion on the back of the wrench head which often prevents the wrench from being usable in hard-to-get-to restricted areas.

SUMMARY OF THE PRESENT INVENTION

The present invention provides a socket release mechanism which provides the benefits hereinbefore set forth in connection with such prior art devices by being able to readily attach and remove various sockets to the drive stud of the wrench. The present invention also provides the added feature of being able to engage and disengage the socket by actuation of a movable member at the outer end of the wrench handle completely remote from the wrench head itself.

The present invention provides a ball detent in one side of the drive stud of the wrench which is actuated by a spring loaded plunger which is reciprocally disposed within the hollow cavity within the drive stud itself. This spring loaded plunger when in its extended position causes one wall thereof to push the detent ball outwardly into engagement with the socket carried by the wrench. On the other hand, this plunger wall is provided with a recess such that when the plunger is depressed, the detent ball may freely move partially into the recess provided in the plunger wall, thereby relieving its outward force on the socket which in turn releases the socket for easy removal and replacement.

The inner end of the plunger is provided with a actuator rod having a hemispherical upper surface which extends into the hollow wrench head. The elongated handle of the wrench is provided with a longitudinal bore therethrough which reciprocally carries a shaft, the outer end of which extends outside the outer end of the wrench handle where it is provided with a knob or button for either depressing the shaft or retracting the shaft with respect to the handle member. The inner end of the shaft is provided with a cone-shaped actuator member which is engageable with the hemispherical end of the plunger actuator member.

Therefore, when it is desirable to depress the plunger to release the socket being carried by the drive stud, the shaft is moved inwardly and the conical end of the shaft thereby forces the plunger downwardly to allow the detent ball to recede into the plunger wall recess. Retraction of the shaft then allows the spring loaded plunger to move inwardly, the wall of that plunger forcing the detent ball outwardly against the socket being carried by the drive stud.

Therefore, it is apparent that the present invention allows the design of the wrench head to be clear of any obstruction such as a push-button actuator and further allows the releasing and engagement of the ball detent to be controlled completely at the end of the wrench handle as opposed to a wrench head itself.

DESCRIPTION OF THE DRAWINGS

Other and further advantageous features of the present invention will hereinafter more fully appear in connection with the detailed description of the drawings in which.

DESCRIPTION OF THE PREFERRED EMBODIMENT

Figure 1:
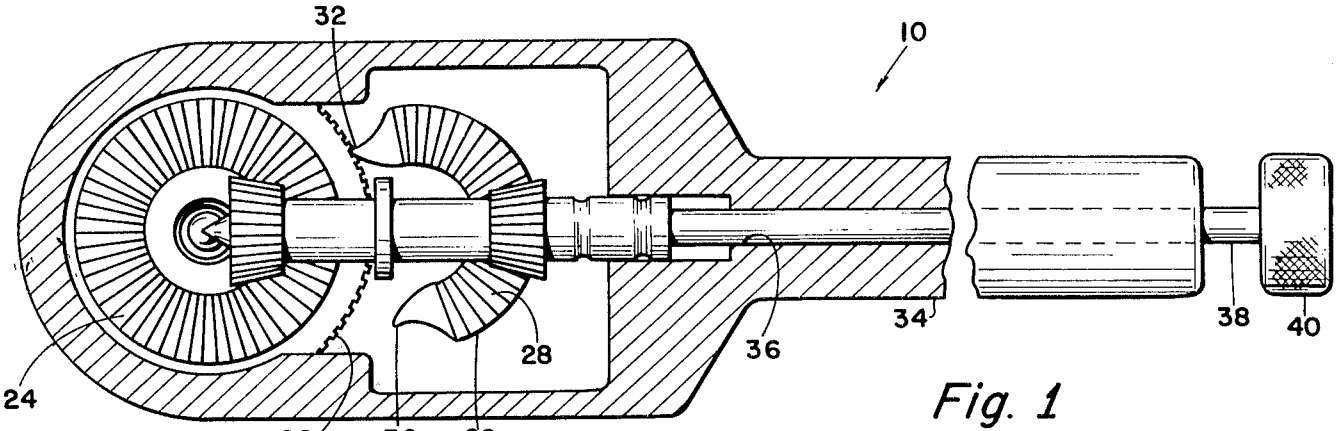
FIG. 1 is a plan view, partially in section of a wrench embodying the present invention.

Referring to the drawings in detail, reference character 10 generally indicates a ratchet wrench which is similar in construction and operation to that of co-pending application of Harvey M. Main and Doug Main, Ser. No. 822,749 filed Aug. 8, 1977 for a Bolt Starting Device. The detailed construction and operation of the wrench is described in said co-pending application and will be only briefly outlined herein. The wrench 10 generally comprises a wrench head 12 having the hollow interior 14, one surface of said wrench head being provided with an aperture 16 having an outwardly extending drive stud 18 rotatably journalled therein. The drive stud 18 also comprises a cylindrical gear wheel 20 which is provided with circumferential ratchet gear teeth 22 around the outer periphery thereof, the inside surface of which is provided with a concave bevel gear 24.

Pivotally mounted within the hollow interior 14 of the wrench head 12 is a switchable pawl member 26 which is generally semi-circular in shape and provided with convex bevel gear 28. The pawl member 26 is provided with ratchet gear engagement members 30 and 32 which are alternately engageable with the ratchet gear teeth 22.

An elongated wrench handle member 34 is rigidly secured to the wrench head 12 and may be made an integral part thereof. The wrench handle 34 extends outwardly at a right angle to the rotational axis of the drive stud 18. A longitudinal bore 36 is provided through the wrench handle 34 and extends into open communication with the hollow interior 14 of the wrench head 12.

An elongated operator shaft 38 is slidably and rotatably disposed in the bore 36, the outer end of said operator shaft 38 terminating outside the end of the wrench handle with an operator knob 40. The shaft 38 is circular in cross-sectional shape and the inner end portion thereof which extends into the hollow interior 14 of the wrench head is reduced in size and is provided with a square cross-sectional shape. This reduced shaft portion is hereinafter referred to by reference character 42. The inner end of the operator shaft member 42 is provided with a cone-shaped operater member 42.

Surrounding the operator shaft 42 is an elongated operator sleeve member 46 having at the inner end thereof a bevel gear 48 in the shape of a truncated cone, the small end of which is directed toward the wrench handle. A second truncated cone-shaped bevel gear 50 is provided on the sleeve member 46 and spaced from the gear 48, the small end of said bevel gear 50 facing away from the handle member. Between the bevel gears 48 and 50 is an outwardly extending flange member 52 for centering the pawl member 26.

Ordinary operation of the wrench as fully set out in the aforementioned co-pending application is summarized as follows. When it is desired to change the ratchet direction of the wrench, the knob 40 is pushed inwardly so that the bevel gear 50 engages the pawl bevel gear 28. The knob is then rotated in one direction or the other to engage one of the pawl members 30 or 32 with the ratchet gear 22. The wrench may then be used as an ordinary ratchet wrench.

On the other hand, if it is desired to rotate the drive stud 18 remotely from the end of the handle without turning the wrench itself, the knob member 40 is withdrawn thereby engaging the bevel gear 48 with the concave bevel 24 and then twisting the knob 40 in the desired direction of rotation of the drive stud 18 for "finger tightening" or "finger loosening" of a nut or bolt.

In the present invention, a longitudinal bore 54 is provided in the stud member 18 to produce a cavity therein. The bore extends through the cylindrical member 20 and into the stud member, the outer end of the cavity 54 being closed, the inner end being in open communication with the hollow interior 14 of the wrench head.

A cylindrical plunger member 56 is reciprocally disposed in the cavity 54, the inner end portion of the plunger being of a reduced size and having a hemispherical end 58. A retainer ring 60 is carried by the cylindrical gear wheel 20 which surrounds the inner reduced end portion of the plunger for the purpose of maintaining the plunger within the cavity 54. The outer end of the plunger 56 is provided with a longitudinal bore 60 for receiving a spring member 62 therein. The spring member 62 is a compression spring that acts between the outer end of the cavity and the outer end of the plunger to force the plunge inwardly against the retainer ring 60. An angular groove 64 is provided around the wall of the plunger 56 and is spaced from the outer end of the plunger for a purpose that will be hereinafter set forth.

The stud member 18 is provided with a bore 66 through the side thereof, the bore 66 having a reduced outer diameter for maintaining a movable detent ball 68 therein.

As hereinbefore stated, the operator shaft 42 has a square cross-sectional shape which is reciprocally disposed within a longitudinal aperture 70 within the operator sleeve member 46. Further, the cone-shaped operator member 44 at the inner end of said shaft 42 is contactable with the hemispherical end 58 of the plunger 56. The outer end of the operator sleeve member is provided with a longitudinal bore 72 for housing a compression spring member 74 which tends to urge the shaft member 42 outwardly toward the wrench handle with respect to the operator sleeve member 46. The end bevel gear 48 at the end of the operator sleeve member 46 is provided with a longitudinal bore 76 capable of receiving the cone-shaped operator member 44 therein when the operator shaft 42 is fully withdrawn.

Figure 2:
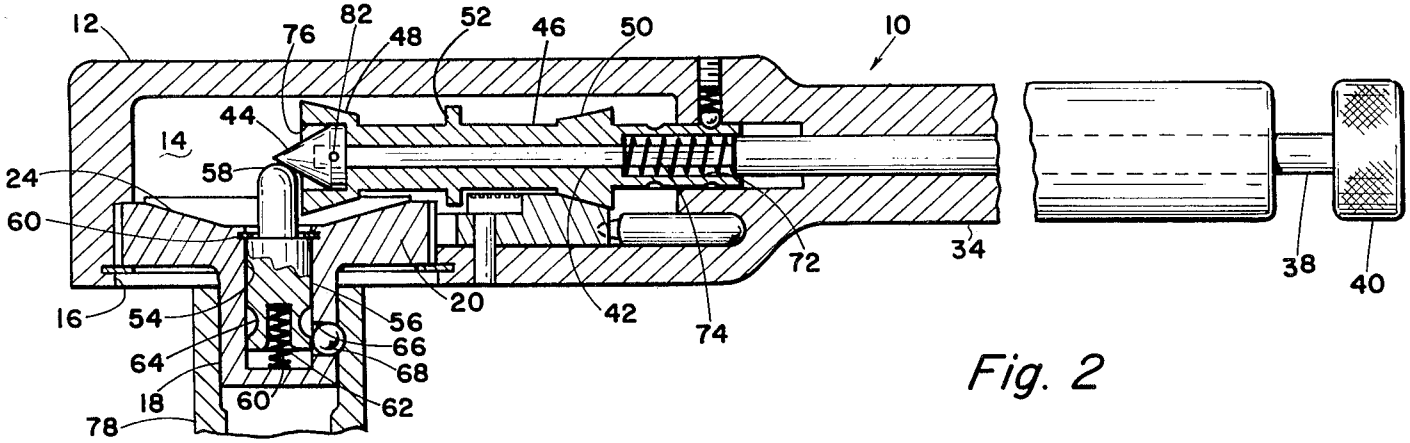
FIG. 2 is a side elevational view, partially in section of the wrench of FIG. 1.
Figure 4:
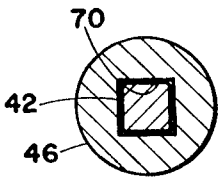
FIG. 4 is an end elevational sectional view of the actuator shaft only of FIG. 3 taken along the broken lines 4—4 of FIG. 3.

As can be seen clearly by FIG. 2, when the operator shaft 42 is withdrawn, the plunger member 56 is in its innermost position, the wall of the plunger member 56 forcing the detent ball 68 outwardly for securing a typical socket member 78 thereon.

Figure 3:
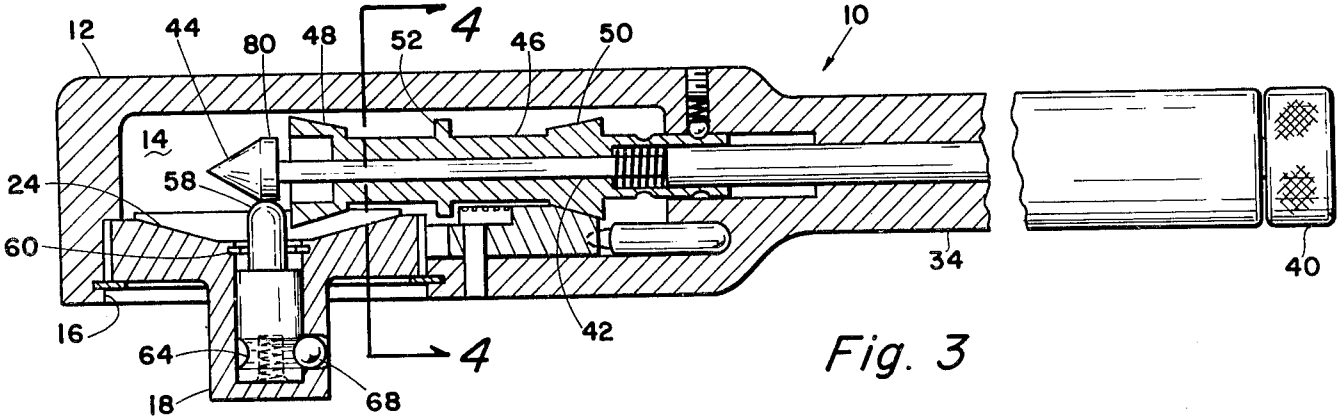
FIG. 3 is a side elevational view, partially in section, of the wrench of FIG. 1 with the actuator mechanism in a second position.

When it is desirable to release the socket member 78, the knob 40 is fully depressed as shown in FIG. 3 thereby causing a camming action between the cone-shaped operator member 44 and the hemispherical end portion 58 of the plunger 56 thereby depressing the plunger 56 against the force of the spring member 62. When the plunger member 56 is fully depressed as shown in FIG. 3, the annular recess 64 in the plunger wall comes into alignment with the detent ball 68 thereby allowing said detent ball to recede partially into the annular recess 64 thereby releasing the socket member 68.

In this embodiment, the cone-shaped operator member 44 is provided with a cylindrical segment 80 at the base thereof, which in turn is provided with a pin member 82 for attachment to the outer end of the operator rod 42. This cylindrical portion 80 of the cone member while not being necessary to the operation of the plunger, does provide ease of attachment of the cone-shaped operator member 44 to the end of the rod 42. This further provides a flattened surface to control the amount that the plunger 56 is depressed. However, the length of the plunger may be sized to fit the cavity 54 so that when the outer end thereof is fully depressed against the outer end of the cavity, the annular grooves 64 is in alignment with the detent ball.

Figure 6:
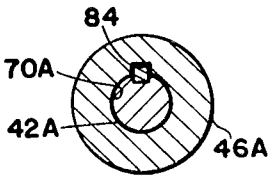
FIG. 6 is an end sectional view of the shaft only of FIG. 5 taken along the broken line 6—6 of FIG. 5.
Figure 5:
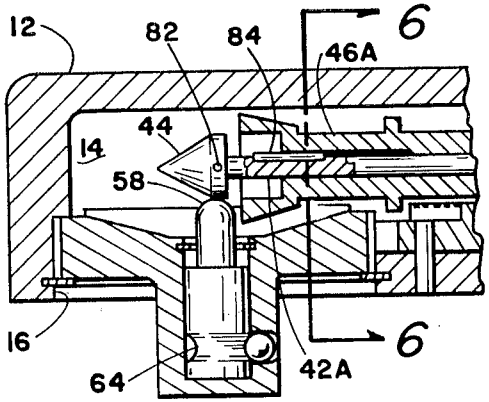
FIG. 5 is a partial side elevational sectional view of a second embodiment of the invention.

The primary reason for the square shaped cross-section of the operator shaft 42 is so that when the knob member 40 is rotated, the operator sleeve member 46 rotates therewith. FIGS. 5 and 6 relate to an alternate solution which would permit an operator shaft 42A to have a circular cross-section to fit a longitudinal bore 70A in the sleeve member 46A. To provide simultaneous rotation of both the operator rod 42A and the sleeve member 46A, an elongated slidable key member 84 may be provided between the two members to force simultaneous rotation thereof.

It can further be readily seen that although this particular invention has been described in relation to the drawings of a wrench in which the ratchet action is controlled at the outer end of the handle, this invention can be applied to an ordinary ratchet wrench in which ratchet control is provided by a lever on the back of the wrench head (not shown). Further, it can be seen that this socket release mechanism described in the present application can be applied to an ordinary right angle breaker wrench without the ratcheting function.

Whereas the present invention has been described in particular relation to the drawings attached hereto, other and further modifications apart from those shown or suggested herein may be made within the spirit and scope of the invention.

For instance the shape of the contacting actuator member such as the cone-shaped opertor member 44 and the hemispherical shaped plunger actuator 58 may be varied somewhat, it is felt that the design shown herein is the preferred embodiment such that the camming action of the cone shaped on the hemispherical top will provide smooth action of the plunger member 56.

I claim:

1. A socket wrench comprising;

a hollow wrench head, a drive stud extending outwardly from the wrench head, a cavity provided in the drive stud closed to the outer end of the drive stud and opening into the interior of the hollow wrench head, a detent ball movably carried by the stud member and engageable with a socket carryable by said stud member, means carried within the stud cavity for selectively engaging and disengaging the detent ball, an elongated handle carried by the wrench head and extending outwardly therefrom at a right angle to the stud member, a longitudinal bore provided through the handle, a shaft movable within the bore, means at the outer end of the shaft exterior of the outer end of the handle for moving such shaft and means carried by the inner end of the shaft operably engageable with the means for selectively engaging and disengaging the detent ball, whereby movement of the shaft to a first position engages the detent ball and movement to a second position disengages the detent ball.

2. A socket wrench as set forth in claim 1 wherein the means carried within the stud cavity for selectively engaging and disengaging the detent ball comprises a spring-loaded plunger member reciprocally disposed in the cavity and having a detent ball engaging wall, and an annular recess in the outer periphery of said wall, and having a first position in which the wall forces the detent ball outwardly to engage and secure the socket, and a second depressed position wherein the recess is in alignment with the detent ball to allow said detent ball to retract sufficiently to disengage and release the socket.

3. A socket wrench as set forth in claim 2 wherein the plunger inner end is provided with a first cam surface and wherein the shaft is reciprocally disposed in the handle bore, said means carried by the inner end of the shaft comprising a second cam surface contactable with the plunger cam surface, whereby upon longitudinal movement of the shaft toward the wrench head, the cam surfaces interact to depress the plunger and movement of the shaft in the opposite direction releases said plunger.

4. A socket wrench as set forth in claim 3 wherein the first cam surface is hemispherical and the second cam surface is conical in shape.

5. A socket wrench as set forth in claim 1 wherein said socket wrench is also a ratchet wrench having a movable pawl switch carried in the hollow wrench head for effecting rotation of the drive stud in either direction, and including pawl switch operator means movably carried by the shaft and disposed in the hollow wrench head wherein longitudinal movement of the shaft selectively engages and disengages said detent ball and wherein rotation of said shaft effects rotation of said pawl switch operator means for operating said pawl switch.

6. A socket wrench as set forth in claim 5 wherein said pawl switch operator means comprises a sleeve member slidably disposed on said shaft and keying means to prevent rotation of said sleeve member with respect to the shaft.

7. A socket wrench as set forth in claim 1 wherein the drive stud is rotatable and is provided with gearing means disposed inside the hollow wrench head, second gearing means movably carried by the shaft wherein longitudinal movement of the shaft selectively engages and disengages said ball detent and wherein rotation of said shaft provides rotation of said first and second gearing means to effect rotation of the drive stud.

8. A socket wrench as set forth in claim 7 wherein said second gearing means comprises a sleeve member slidably disposed on said shaft and keying means to prevent rotation of the gearing means with respect to the shaft.

* * * * *